United States Patent [19]

Duthu

[11] 4,423,472

[45] Dec. 27, 1983

[54] PORTABLE BARGE LIGHTS

[76] Inventor: Raymond H. Duthu, P.O. Box 1007, Marrero, La. 70072

[21] Appl. No.: 388,496

[22] Filed: Jun. 14, 1982

[51] Int. Cl.[3] ..... F21V 21/00

[52] U.S. Cl. ..... 362/184; 362/158; 362/190; 362/200; 362/231; 362/293; 362/375; 362/399; 362/398; 362/267; 362/61; 362/802

[58] Field of Search ..... 362/184, 190, 802, 191, 362/398, 231, 200, 238, 293, 239, 375, 158, 399, 267, 61

[56] References Cited

U.S. PATENT DOCUMENTS 4,302,800 11/1981 Pelletier ..... 362/250

*Primary Examiner*—Stephen J. Lechert, Jr.

*Attorney, Agent, or Firm*—C. Emmett Pugh; Stanley Renneker

[57] ABSTRACT

A portable navigation light system for barges in which the legally required three lights are provided by a set of three, self-contained units. Each unit contains its own power supply, light activating machanism, light source so configured as to show over the required arc of the horizon with the required range of visibility, and means for affixing the unit to the barge. Each unit incorporates an integral carrying handle and is configured so that the three units nest one inside of the other with their respective handles coinciding as one, thereby permitting the carrying of the nested units as one.

10 Claims, 10 Drawing Figures

PORTABLE BARGE LIGHTS

BACKGROUND OF THE INVENTION

1. Field of the Invention

This invention relates to improvements in the system of navigation lights for barges under tow in the inland waters of the United States. In particularly, this invention advances a system incorporating totally self-contained portable light units with the additional feature of being able to be nested one inside the other for easy handling and storage.

2. Prior Art

United States law requires that vessels under tow upon the inland waters of the United States display navigation lights when being towed from sunset to sunrise. The actual navigation lights required are dependent upon the configuration of the tow. The visible range of the required lights is dependent upon the length of the tow. The visible arc of the horizon of the required light is dependent upon the nature of the light. The specifics of each of the foregoing parameters is set forth in Public Law 95-591: "Inland Navigation Rules Action of 1980".

The practice of the marine industry on the inland waters of the United States is to use portable lights to meet the above stated requirements.

In some instances, a portable unit containing a lamp, the appropriate lens and the necessary screen is mounted on a fixed support and connected to an external power source. The power source is usually located on the towing vessel and in many instances is integral with the towing vessels own electrical power system. The transmission system is usually a portable electrical cable laid out across the weather deck of the towed vessel. In other instances a lamp and lens unit is affixed to a six bolt battery and electrically connected by small wire leads or "pigtails". This composite is lashed into position on the towed vessel.

In both instances the attempt to satisfy the statutory requirements results in a cumbersome system.

The patents listed below were noted in a search and may be considered of interest:

U.S. Pat. Nos.

1,618,816; 1,822,619; 2,420,634; 2,875,324; 3,403,249; 3,456,102; 3,706,882; 3,793,515; 3,944,806.

3. Summary Discussion of the Invention

It is therefore an object of the present invention to provide a totally self-contained navigation light system wherein each unit contains its own power supply, light activating mechanism, lamp, lens, screens and means for affixing the unit to the towed vessel.

It is another object of the present invention to incorporate in each unit an integral carrying handle.

It is still another object of the present invention to configure each unit so that the required units comprising the system will nest one inside the other with their respective handles coinciding as one thereby permitting the carrying of the nested units as one.

BRIEF DESCRIPTION OF THE DRAWINGS

The objects and advantages of the present invention and a full understanding thereof may be had by referring to the following detailed description and the claims taken together with the accompanying drawings, briefly described below in which like parts are give like reference numerals.

DETAILED DESCRIPTION OF THE PREFERRED EMBODIMENT

Figure 1:
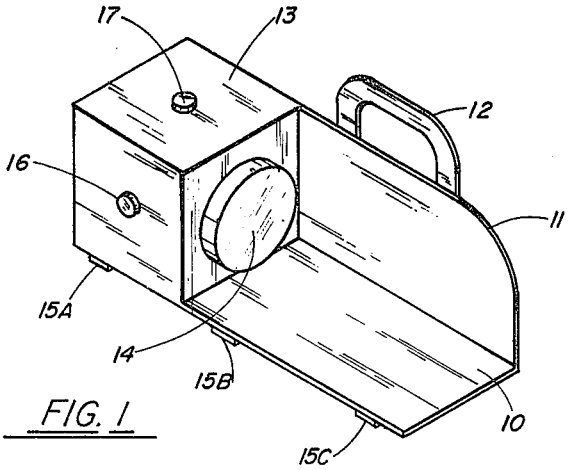
FIG. 1 is a perspective view of the preferred embodiment of the starboard sidelight in which is presented the basic elements of the unit.
Figure 1A:
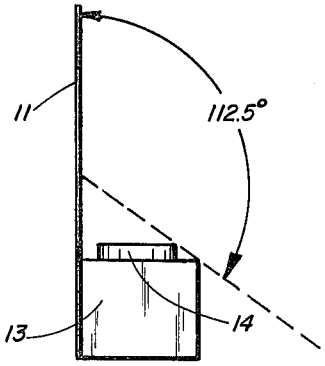
FIG. 1A is an overhead view of the preferred embodiment of the starboard sidelight in which is shown the visible arc of the horizon.

Referring to FIG. 1 there is shown the preferred embodiment of the starboard sidelight. Enclosure 13 contains a battery power source which, when activated by either the manual switch 16 or the light sensing switch 17, illuminates a lamp which is visible through the green lens 14. The visible arc of the horizon of the lamp is 112.5 degrees, from right ahead to 22.5 degrees abaft of the beam, as controlled by the screen 11 and the projection of the lens 14 from the enclosure 13, as depicted in FIG. 1A. The base 10 is fitted with magnets 15A, 15B, 15C for affixing the unit to its mounting surface. Integral with the screen 11 is a carrying handle 12.

Figure 2A:
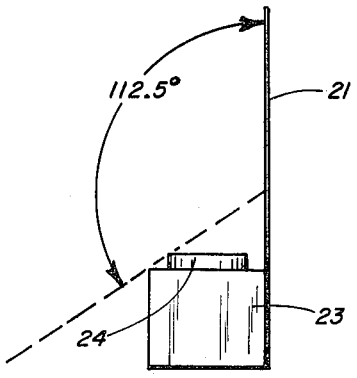
FIG. 2A is an overhead view of the preferred embodiment of the port sidelight in which in shown the visible arc of the horizon.
Figure 2:
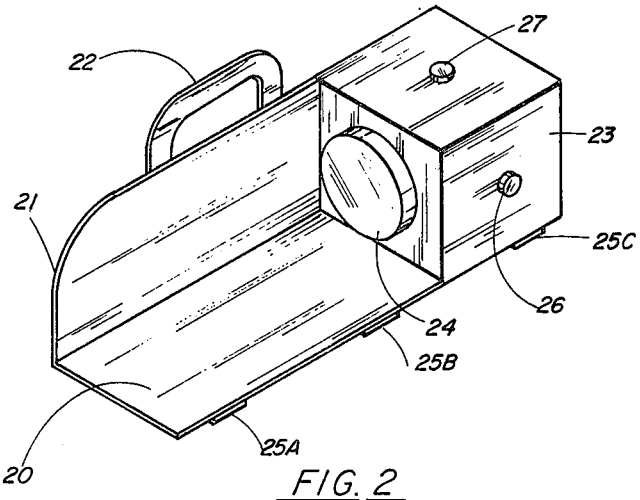
FIG. 2 is a perspective view of the preferred embodiment of the port sidelight in which is presented the basic elements of the unit.

Referring to FIG. 2 there is shown the preferred embodiment of the port sidelight. Enclosure 23 contains a battery power source which, when activated by either the manual switch 26 or the light sensing switch 27 illuminates a lamp which is visable through the red lens 24. The visible arc of the horizon of the lamp is 112.5 degrees, from left ahead to 22.5 degrees abaft of the beam, as controlled by the screen 21 and the projection of the lens 24 from the enclosure 23, as depicted in FIG. 2A. The base 20 is fitted with magnets 25A, 25B, 25C for affixing the unit to its mounting surface. Integral with the screen 21 is a carrying handle 22.

Figure 3:
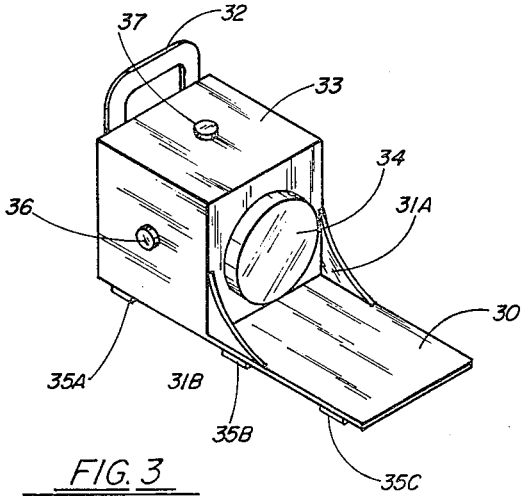
FIG. 3 is a perspective view of the preferred embodiment of the special flashing light in which is presented the basic elements of the unit.
Figure 3A:
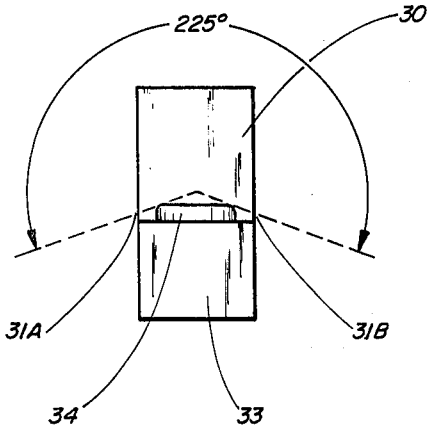
FIG. 3A is an overhead view of the preferred embodiment of the special flashing light in which is shown the visible arc of the horizon.

Referring to FIG. 3, there is shown the preferred embodiment of the special flashing light. Enclosure 33 contains a battery power source which, when activated by either the manual switch 36 or the light sensing switch 37, illuminates a lamp which flashes at regular intervals at a frequency of 50 to 70 flashes per minute and is visible through a yellow lens 34. The visible arc of the horizon of the lamp is 225 degrees, from right ahead to 22.5 degrees abaft of the beam, as controlled by the screens 31A, 31B and the projection of the lens 34 from the enclosure 33, as depicted by FIG. 3A. The base 30 is fitted with magnets 35A, 35B, 35C for affixing the unit to its mounting surface. Integral with the enclosure 33 is the carrying handle 32.

Figure 4:
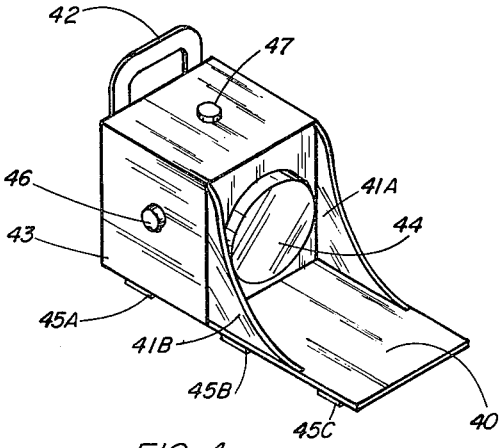
FIG. 4 is a perspective view of the preferred embodiment of the stern light in which is presented the basic elements of the unit.
Figure 4A:
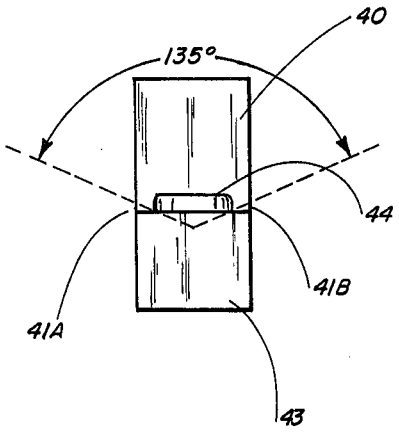
FIG. 4A is an overhead view of the preferred embodiment of the stern light in which is shown the visible arc of the horizon.

Referring to FIG. 4 there is shown the preferred embodiment of the stern light. Enclosure 43 contains a battery power source which when activated by either the manual switch 46 or the light sensing switch 47 illuminates a lamp which is visible through the white lens 44. The visible arc of the horizon of the lamp is 135 degrees, 67.5 degrees from right aft on each side of center, as controlled by the screens 41A, 41B and the projection of the lamp 44 from the enclosure 43, as depicted by FIG. 4A. The base 40 is fitted with magnets 45A, 45B, 45C for affixing the unit to its mounting surface. Integral with the enclosure 43 is the carrying handle 42.

Figure 5:
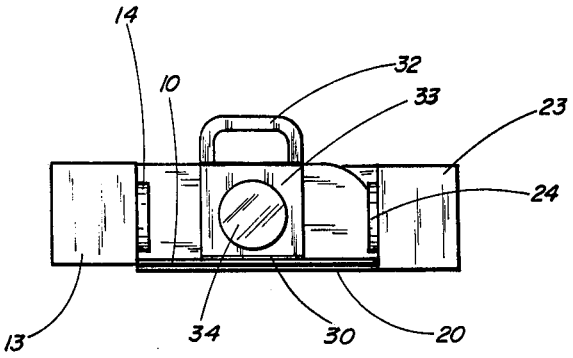
FIG. 5 is a front view of the preferred embodiment of the starboard sidelight, port sidelight and special flashing light nested for handling and storage.
Figure 6:
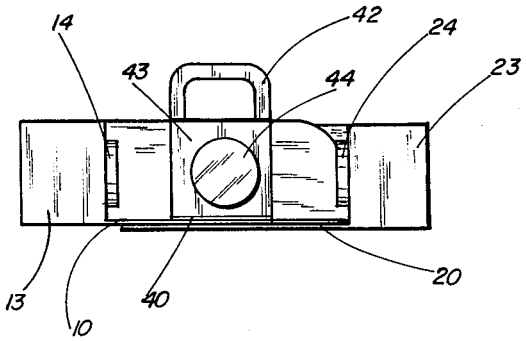
FIG. 6 is a front view of the preferred embodiment of the starboard sidelight, port sidelight and stern light nested for handling and storage.

Referring to FIGS. 5 and 6 there is shown the preferred embodiments of the nested starboard sidelight, port sidelight and special flashing light and the starboard sidelight, port sidelight and stern light, respectively. In both nesting arrangements the base 10 of the starboard sidelight is set upon the base 20 of the port sidelight and positioned so the integral handle 12 on the screen 11 of the starboard sidelight coincides with the integral handle 22 on the screen 21 of the port sidelight. In the case of the special flashing light, FIG. 5, the base 30 of the special flashing light is set upon the base 10 of the starboard sidelight and positioned so the integral handle 32 of the enclosure 33 of the special flashing light coincides with the integral handle 12 on the screen 11 of the starboard sidelight and the integral handle 22 on the screen 21 of the port sidelight. In the case of the stern light, FIG. 6, the base 40 of the stern light is set upon the base 10 of the starboard sidelight and positioned so the integral handle 42 of the enclosure 43 of the stern light coincides with the integral handle 12 on the screen 11 of the starboard sidelight and the integral handle 22 on the screen 21 of the port sidelight.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A three unit portable navigation light system for a marine vessel, comprising:

a totally self-contained port sidelight having a portable power source, an associated lamp, and an enclosure having a bottom edge and two side edges housing said power source and said associated lamp, at least one activating means associated with said lamp for switching said lamp, a red lens mounted on said enclosure over said lamp, a base extending horizontally out from the bottom edge of the side of said enclosure and away from the surface of said enclosure on which is mounted said lens, a screen extending from a side edge of said enclosure perpendicular to said base and fixedly attached to the edge of said base and extending out away from the surface of said enclosure on which is mounted said lens, a carrying handle attached to said screen and a securing means attached to said base for removably securing the base to the marine vessel;

a totally self-contained starboard sidelight, said port and said starboard sidelights being removeably nestable together one upon the base of the other, said starboard sidelight having a portable power source, an associated lamp, and an enclosure having a bottom edge and two side edges housing said power source and said associated lamp, at least one activating means associated with said lamp for switching said lamp, a green lens mounted on said enclosure over said lamp, a base extending horizontally out from the bottom edge of the side of said enclosure on which is mounted said lens, a screen extending from a side edge of said enclosure perpendicular to said base and fixedly attached to the edge of said base and extending out away from the surface of said enclosure on which is mounted said lens, a carrying handle attached to said screen and coinciding in position to the handle on said port sidelight when said sidelights are nested together, and securing means attached to said base for removably securing the base to the marine vessel; and a totally self-contained yellow light removably nestable upon the base of one of said sidelights, said yellow light having a portable power source, an associated lamp, and an enclosure having a bottom edge and two side edges housing said power source and said associated lamp, at least one activating means for switching said lamp, a yellow lens mounted on said enclosure over said lamp, a base extending horizontally out from the bottom edge of the side of said enclosure and extending out away from the surface on which is mounted said lens, two, opposed screens extending from the side edges of said enclosure perpendicular to said base and fixedly attached to the side edges of said base and extending out away from the surface of said enclosure on which is mounted said lens, a carrying handle attached to said enclosure and coinciding in position to the handles on said port and starboard sidelights when the three lights are nested together, and securing means attached to said base for removably securing the base to the marine vessel.

2. The three unit portable navigation light system of claim 1, wherein each of said power sources is a battery.

3. The three unit portable navigation light sytem of claim 1, wherein each of said securing means includes at least one magnet.

4. The three unit portable navigation light system of claim 1, wherein each of said activating means is a manual switch.

5. The three unit portable navigation light system of claim 1, wherein each of said activating means is a light sensing switch.

6. A three unit portable navigation light system for a marine vessel, comprising:

a totally self-contained port sidelight having a portable power source, an associated lamp, and an enclosure having a bottom edge and two side edges housing said power source and said associated lamp, at least one activating means for switching said lamp, a red lens mounted on said enclosure over said lamp, a base extending horizontally out from the bottom edge of the side of said enclosure and extending away from the surface of said enclosure on which is mounted said lens, a screen extending from a side edge of said enclosure perpendicular to said base and fixedly attached to the side edge of said base and extending away from the surface of said enclosure on which is mounted said lens, a carrying handle attached to said screen, and securing means attached to said base for removably securing the base to the marine vessel;

a totally self-contained starboard sidelight, said port and said starboard sidelights being removeably nestable together one upon the base of the other, said starboard sidelight having a portable power source, an associated lamp, and an enclosure having a bottom edge and two side edges housing said power source and said associated lamp, at least one activating means for switching said lamp, a green lens mounted on said enclosure over said lamp, a base extending horizontally out from the bottom edge of the side of said enclosure on which is mounted said lens, a screen extending from a side edge of said enclosure perpendicular to said base and fixedly attached to a side edge of said base and extending away from the surface of said enclosure on which is mounted said lens, a carrying handle attached to said screen and coinciding in position to the handle on said port sidelight when said sidelights are nested together, and securing means attached to said base for removably securing the base to the marine vessel; and a totally self-contained stern light removeably nestable upon the base of one of said sidelights, said stern light having a portable power source, an associated lamp, and an enclosure having a bottom edge and two side edges housing said power source and said associated lamp, at least one activating means for switching said lamp, a white lens mounted on said enclosure over said lamp, a base extending horizontally out from the bottom edge of said enclosure and extending away from the surface on which is mounted said lens, two, opposed screens extending from the side edges of said enclosure extending away from the surface of said enclosure on which is mounted said lens, a carrying handle attached to said enclosure and coinciding in position to the handles on said port and starboard sidelights when all three lights are nested together, and securing means attached to said base for removably securing the base to the marine vessel.

7. The three unit portable navigation light system of claim 6, wherein each of said power sources is a battery.

8. The three unit portable navigation light system of claim 6, wherein each of said securing means includes at least one magnet.

9. The three unit portable navigation light system of claim 6, wherein each of said activating means is a manual switch.

10. The three unit portable navigation light system of claim 6, wherein each of said activating means is a light sensing switch.

* * * * *